US008418384B2

(12) United States Patent
Jin et al.

(10) Patent No.: US 8,418,384 B2
(45) Date of Patent: Apr. 16, 2013

(54) POP-UP MUSICAL GREETING CARDS

(75) Inventors: Eva Jin, Shanghai (CN); Beth Laverdiere, Rocky River, OH (US); David Sapp, North Ridgeville, OH (US); Seth Larson, Lakewood, OH (US); Johnathan Talbot, Bay Village, OH (US)

(73) Assignee: American Greetings Corporation, Cleveland, OH (US)

( * ) Notice: Subject to any disclaimer, the term of this patent is extended or adjusted under 35 U.S.C. 154(b) by 105 days.

(21) Appl. No.: 13/171,573

(22) Filed: Jun. 29, 2011

(65) Prior Publication Data

US 2012/0000100 A1 Jan. 5, 2012

Related U.S. Application Data

(60) Provisional application No. 61/359,903, filed on Jun. 30, 2010.

(51) Int. Cl.

| | |
|---|---|
| ***G09F 1/00*** | (2006.01) |
| ***G09F 27/00*** | (2006.01) |
| ***A63H 33/00*** | (2006.01) |
| ***B65D 25/34*** | (2006.01) |

(52) U.S. Cl.

USPC ..... 40/124.02; 40/124.14; 40/124.08; 40/124.16; 40/124.03; 40/455; 446/488; 446/486; 229/116.4

(58) Field of Classification Search ..... 40/124.02, 40/124.14, 124.08, 124.16, 124.03, 455; 446/488, 486; 229/116.4

See application file for complete search history.

(56) References Cited

U.S. PATENT DOCUMENTS

| | | | | |
|---|---|---|---|---|
| 1,092,321 | A * | 4/1914 | Wiplitzhauser | 446/488 |
| 4,146,983 | A | 4/1979 | Penick et al. | |
| 4,313,270 | A | 2/1982 | Volkert | |
| 4,337,589 | A | 7/1982 | Volkert | |
| 4,349,973 | A | 9/1982 | Penick et al. | |
| 4,763,427 | A | 8/1988 | Schrager | |
| 4,794,024 | A | 12/1988 | Crowell et al. | |
| 4,885,859 | A | 12/1989 | Gasser | |
| 4,949,482 | A | 8/1990 | Price | |
| 5,022,681 | A | 6/1991 | Penick | |
| 5,096,751 | A | 3/1992 | Duchek | |
| 5,259,133 | A | 11/1993 | Burtch | |
| 5,261,172 | A | 11/1993 | Rowley | |
| 5,317,823 | A | 6/1994 | Brunt | |
| 5,386,656 | A | 2/1995 | Bergman | |
| 5,450,680 | A | 9/1995 | Bromberg | |
| 5,564,208 | A | 10/1996 | Bergman | |
| 5,582,888 | A | 12/1996 | Volkert | |
| 5,588,233 | A | 12/1996 | Volkert | |

(Continued)

*Primary Examiner* — Joanne Silbermann
*Assistant Examiner* — Syed A Islam
(74) *Attorney, Agent, or Firm* — James C. Scott; Roetzel & Andress

(57) ABSTRACT

An interactive greeting card operative to move between a first position wherein several interconnected panels are folded into a substantially flat position and a second position wherein the several interconnected panels are unfolded into a three-dimensional pop-up structure. Movement between the first and second positions may also control playback of digital audio, activation of one or more LED lights, or various other special effects. An inner sentiment panel is substantially contained within an outer greeting card body and is revealed when the greeting card is moved from the first to the second position. Various openings on the greeting card panels accommodate movement and visibility of the inner sentiment panel.

18 Claims, 8 Drawing Sheets

U.S. PATENT DOCUMENTS

| | | | | |
|---|---|---|---|---|
| 5,611,161 | A | 3/1997 | Murphy | |
| 5,657,875 | A | 8/1997 | Hirsh | |
| 5,682,999 | A | 11/1997 | Larson | |
| 5,711,101 | A * | 1/1998 | Mueller et al. | 40/750 |
| 5,809,673 | A | 9/1998 | Johnson et al. | |
| 5,813,596 | A | 9/1998 | Dahlquist | |
| 5,864,973 | A | 2/1999 | Cole | |
| 5,937,553 | A | 8/1999 | Maran | |
| 6,173,515 | B1 | 1/2001 | Walsh | |
| 6,192,608 | B1 | 2/2001 | Williams | |
| 6,199,308 | B1 | 3/2001 | Westendorp | |
| 6,513,270 | B1 | 2/2003 | Mackenzie | |
| 6,725,588 | B1 | 4/2004 | Swoboda | |
| RE38,696 | E | 2/2005 | Williams | |
| 6,871,433 | B2 | 3/2005 | Anza | |
| 6,966,135 | B1 | 11/2005 | McDonald | |
| 7,111,736 | B2 | 9/2006 | Petter | |
| 7,234,253 | B2 * | 6/2007 | Ossmann | 40/124.14 |
| 7,389,908 | B2 | 6/2008 | Cohen | |
| 7,395,621 | B2 | 7/2008 | Carter | |
| 7,546,702 | B2 | 6/2009 | Malkovas | |
| 7,552,553 | B2 | 6/2009 | Kelly | |
| 7,584,558 | B2 | 9/2009 | Boyd et al. | |
| 7,717,347 | B2 | 5/2010 | Boyd et al. | |
| 7,793,446 | B2 | 9/2010 | Hluchan | |
| 7,845,099 | B2 | 12/2010 | Ross et al. | |
| 8,020,325 | B2 | 9/2011 | Ross et al. | |
| 2003/0097773 | A1 | 5/2003 | Oh | |
| 2003/0230011 | A1 | 12/2003 | Mouyal | |
| 2003/0230012 | A1 | 12/2003 | Mouyal | |
| 2005/0081412 | A1 | 4/2005 | Malkovas | |
| 2006/0086015 | A1 | 4/2006 | Zlotnick et al. | |
| 2007/0113433 | A1 | 5/2007 | Moore | |
| 2007/0169388 | A1 | 7/2007 | Malkovas | |
| 2008/0016732 | A1 | 1/2008 | Gardi | |
| 2008/0127536 | A1 | 6/2008 | Carter | |
| 2008/0229633 | A1 | 9/2008 | Yi | |
| 2008/0236000 | A1 | 10/2008 | Bostick | |
| 2009/0013567 | A1 | 1/2009 | Hluchan | |
| 2009/0064547 | A1 | 3/2009 | Condor | |
| 2011/0047839 | A1 | 3/2011 | Ross et al. | |
| 2011/0258892 | A1 * | 10/2011 | Taylor et al. | 40/124.02 |

* cited by examiner

POP-UP MUSICAL GREETING CARDS

RELATED APPLICATIONS

This application claims priority to U.S. Provisional Patent Application Ser. No. 61/359,903, filed on Jun. 30, 2010, which is incorporated herein in its entirety.

FIELD OF THE INVENTION

The present invention is in the field of greeting cards and social expression products, and more specifically to pop-up greeting cards having sound generating capabilities.

BACKGROUND OF THE INVENTION

For many years paper greeting cards containing text sentiment and associated artwork have been widely used for celebratory occasions such as birthdays, graduations, weddings, and for other commercial purposes. Greeting cards have been made in conventional configurations such as two-panel gate-fold cards with a single fold line between two panels or multiple panels. More recently, greeting cards have been enhanced by incorporating light, sound, electronics or other special effects, although primarily in combination with conventional flat panel greeting cards.

SUMMARY OF THE INVENTION

An interactive greeting card operative to move between a first position wherein several interconnected panels are folded into a substantially flat position and a second position wherein the several interconnected panels are unfolded into a three-dimensional pop-up structure. Movement between the first and second positions may also control playback of digital audio, activation of one or more LED lights, or various other special effects. An inner sentiment panel is substantially contained within an outer greeting card body and is revealed when the greeting card is moved from the first to the second position. Various openings on the greeting card panels accommodate movement and visibility of the inner sentiment panel.

DETAILED DESCRIPTION OF PREFERRED AND ALTERNATE EMBODIMENTS

The greeting card of the present disclosure and related inventions is a three-dimensional "push and pop" musical greeting card. The greeting card is capable of being in a first position wherein the card is folded flat and a second position, wherein the card is unfolded into a three-dimensional structure. The card is moved from the first position to the second position by "pushing" down on a particular area of the card and watching the various card panels "pop" into a three-dimensional figure. The greeting card may also contain electronics that provide light, sound or other special effects.

Figure 1:
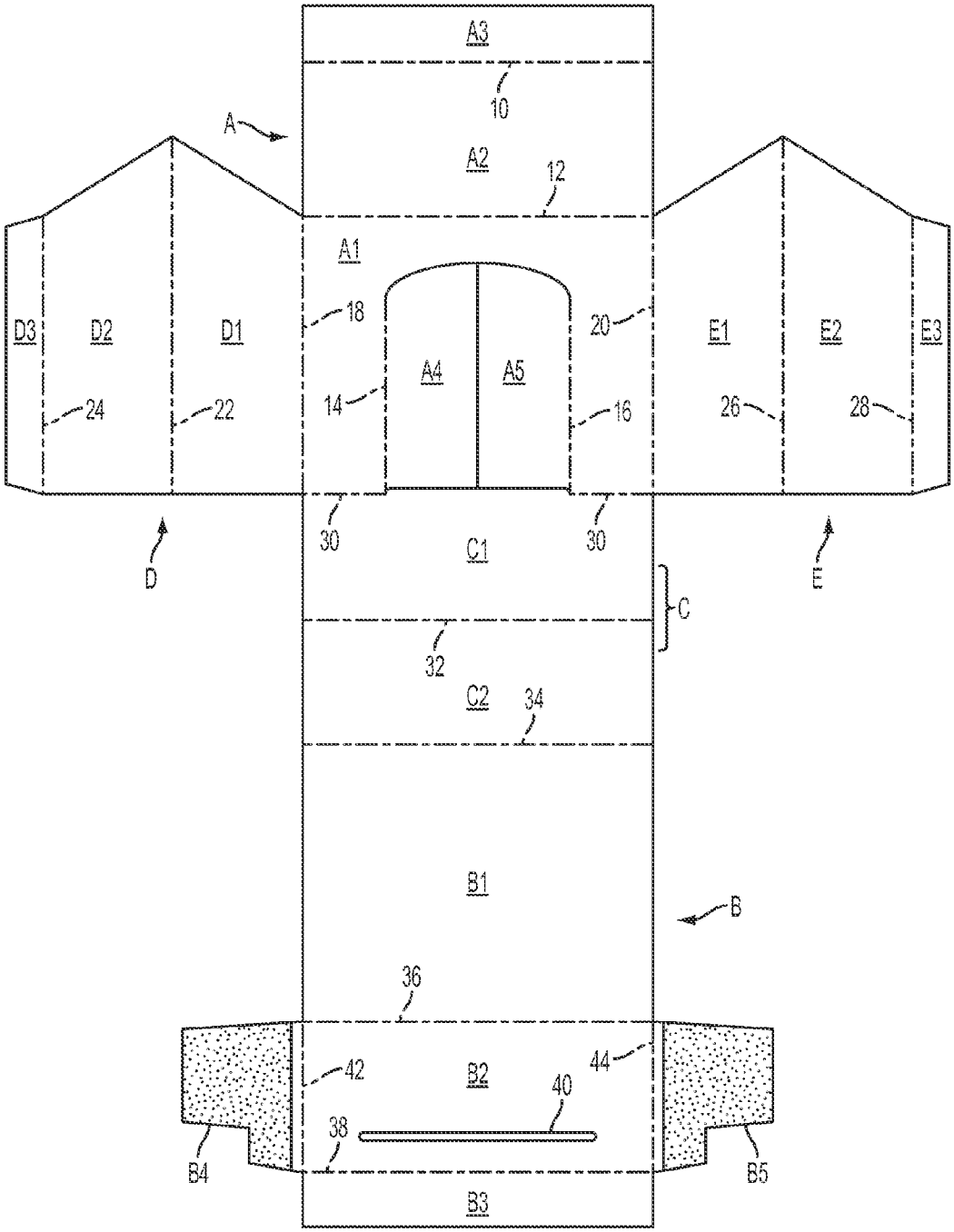
FIG. 1 is a front inside surface view of the outer greeting card construct.
Figure 2:
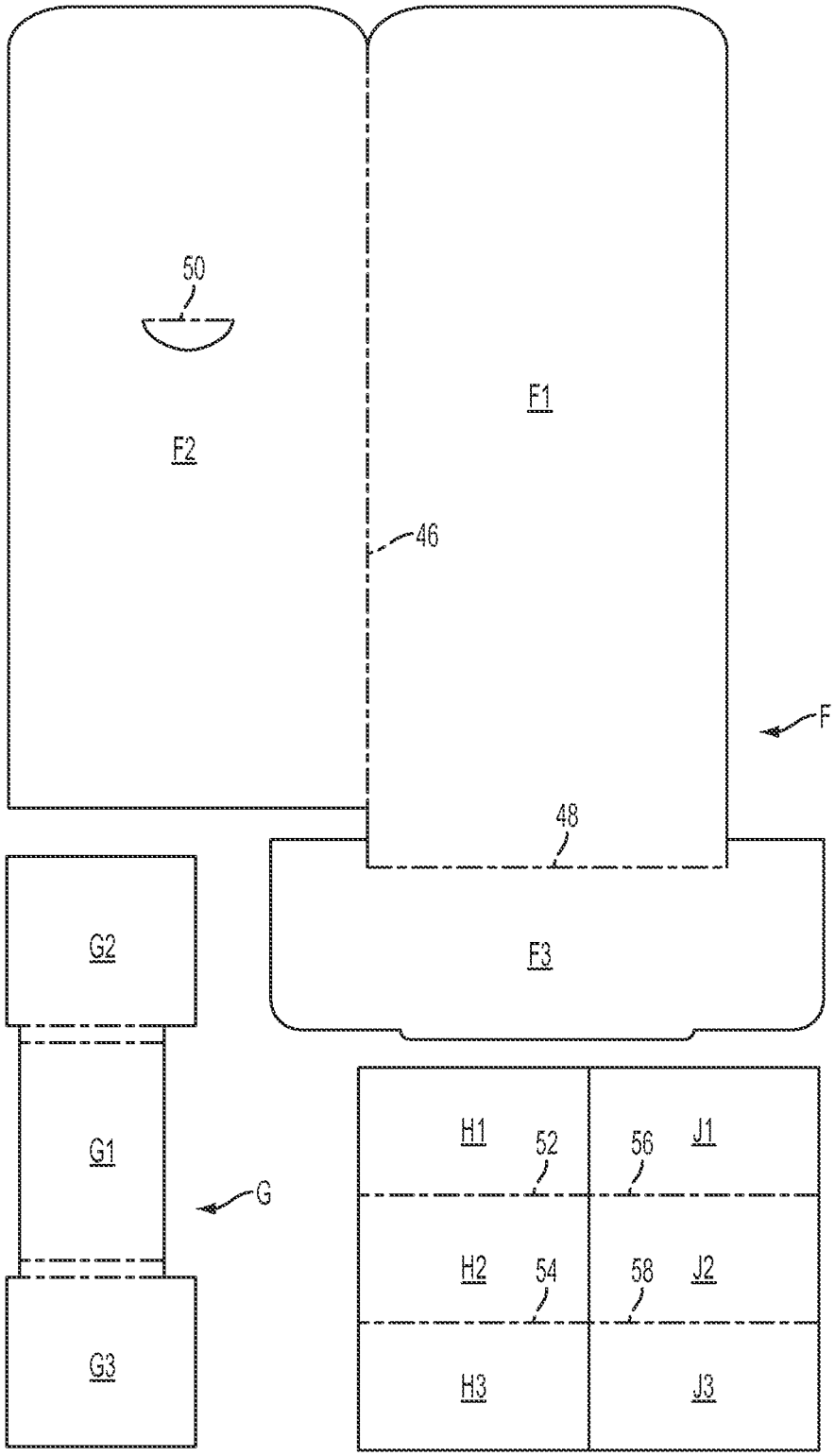
FIG. 2 is a front inside surface view of inner components of the greeting card.

In a preferred embodiment, the greeting card of the present invention resembles a house or a "café". The various components of the greeting card construct are shown in FIGS. 1 & 2. Preferably, the greeting card material is paperboard or other similarly strong but lightweight material. While separate and distinct greeting card panels are shown and described herein, two or more components can be combined into a single panel. The outer greeting card construct is shown in FIG. 1. It includes a plurality of panels connected along a plurality of fold lines, which combine to create the outer or house-like structure. A first main panel A serves as the front of the greeting card. Main panel A is divided into five sub-panels, A1, A2, A3, A4, A5 along fold lines 10, 12, 14, 16. Sub-panels A4 and A5, which are connected to sub-panel A1 along fold lines 14, 16, serve as a door-like structure, wherein they are operative to pivot about fold lines 14 and 16 respectively, simulating an opening/closing motion. On either side of main panel A are main panels D and E. Both main panels D and E are divided into three sub-panels, D1, D2, D3, E1, E2, E3. Panels D and E serve as right and left side panels of the greeting card which partially conceal the various components which are located within the outer greeting card construct. Sub-panels D1 and D2 are bisected by fold line 22 and sub-panels E1 and E2 are bisected by fold line 26. These fold lines allow the sub-panels D1/D2 and E1/E3 to fold inward within the outer card construct so that the greeting card can be completely collapsed into a flat position such that it can be mailed in a traditional greeting card envelope. Sub-panels D3 and E3 attached to the inner surface of sub-panel B1. Main panel A, and more particularly, sub-panel A1 is connected to main panel C along fold line 30. Main panel C is divided equally, along fold line 32, into sub-panels C1 and C2. Sub-panels C1 and C2 are folded outward along fold line 32 when the greeting card is in the first or folded position. Panel C (C1 & C2) serves as the bottom floor of the greeting card when it is in the second or unfolded position. Main panel C, or more particularly, sub-panel C2 is connected to main panel B along fold line 34. Main panel B serves as the back side of the greeting card, which is opposite and parallel to panel A. Panel B is divided into five sections B1, B2, B3, B4, B5 along four fold lines 36, 38, 42 and 44. Sub-panel B2 has an elongate slot or aperture contained thereon to accommodate insertion of a sentiment panel, which will be described in greater detail below. Sub-panels B4 and B5 are folded inward along fold lines 42 and 44 respectively, and attached to the inside surface of sub-panel B2. The inside surface of sub-panel B3 is attached, adhesively or otherwise, to the inside surface of sub-panel A3, thereby inter-connecting main panels A, B, C, D and E to form the outer greeting card construct. Prior to connecting and attaching the various panels to assemble the outer greeting card construct, various inner components must be assembled and attached to the inner surface of main panels A, B and C. The inner components are shown in FIG. 2. A sentiment panel is indicated at reference letter F. Sentiment panel F is divided into three sub-panels F1, F2, F3, which are attached along fold lines 46 and 48. Sub-panel F2 is folded about fold line 46 and attached, adhesively or otherwise, to sub-panel F1 such that the inner surface of sub-panels F1 and F2 are in direct contact. Sub-panel F1 serves as the front of the sentiment panel F and sub-panel F2 serves as the back. Sub-panel F3 is connected to sub-panel F1 along fold line 48 and serves as a base for connected sub-panels F1 and F2. Sub-panel F2 contains a tab 50 thereon, which is used to maintain the greeting card in the second or unfolded position. Sub-panel F3 is attached, adhesively or otherwise, to sub-panel C1 so that sub-panels F1 and F2 are contained between main panel A and main panel B. Sub-panels F1 and F2 are also inserted from the inside into the elongate slot or aperture 40 located on sub-panel B2 so that a small portion of the sentiment panel F is visible from the back side of the greeting card when the greeting card is in the first or folded position and a larger portion is revealed from the front or back of the greeting card when the greeting card is in the second or unfolded position. The sentiment panel F may contain text sentiment and/or graphics printed thereon. When the greeting card is in the second or unfolded position, a portion the front surface of sub-panel F1 can be seen through the "doors" or sub-panels A4 and A5, which pivot inward about fold lines 14 and 16, respectively to reveal a greeting, a message, picture or scene printed on sub-panel F1. Main panel G, which is dived into sub-panels G1, G2 and G3 is used to conceal the electronic components contained within the outer greeting card structure. The electrical components, described in further detail below, are attached, adhesively or otherwise, to sub-panel C2. Main panel G is positioned over the electronic components and attached, adhesively or otherwise, to sub-panel C2. Main panels H and J are used to facilitate the opening and closing of the "doors" or sub-panels A4 and A5. Panel H is folded along fold lines 52 and 54 to form a u-shaped component. Sub-panel H1 is attached, adhesively or otherwise, to the inside surface of sub-panel D1 while sub-panel H3 is attached to the inside surface of sub-panel A4. Likewise, panel J is folded along fold lines 56 and 58 to form a u-shaped component. Sub-panel J1 is then attached to the inside surface of sub-panel E1 while sub-panel J3 is attached to the inside surface of sub-panel A5. When the greeting card is in a first or folded position, panel H is folded flat between panels D1 and A4 and panel J is folded flat between sub-panels E1 and A5. When the greeting card is moved to the second or unfolded position, the side panels D and E are unfolded about fold lines 22 and 26 respectively, thereby pulling panels H and J respectively into an unfolded position which moves sub-panels A4 and AS inward, giving the appearance of a pair of French doors opening inward to reveal a portion of the sentiment panel.

Figure 5:
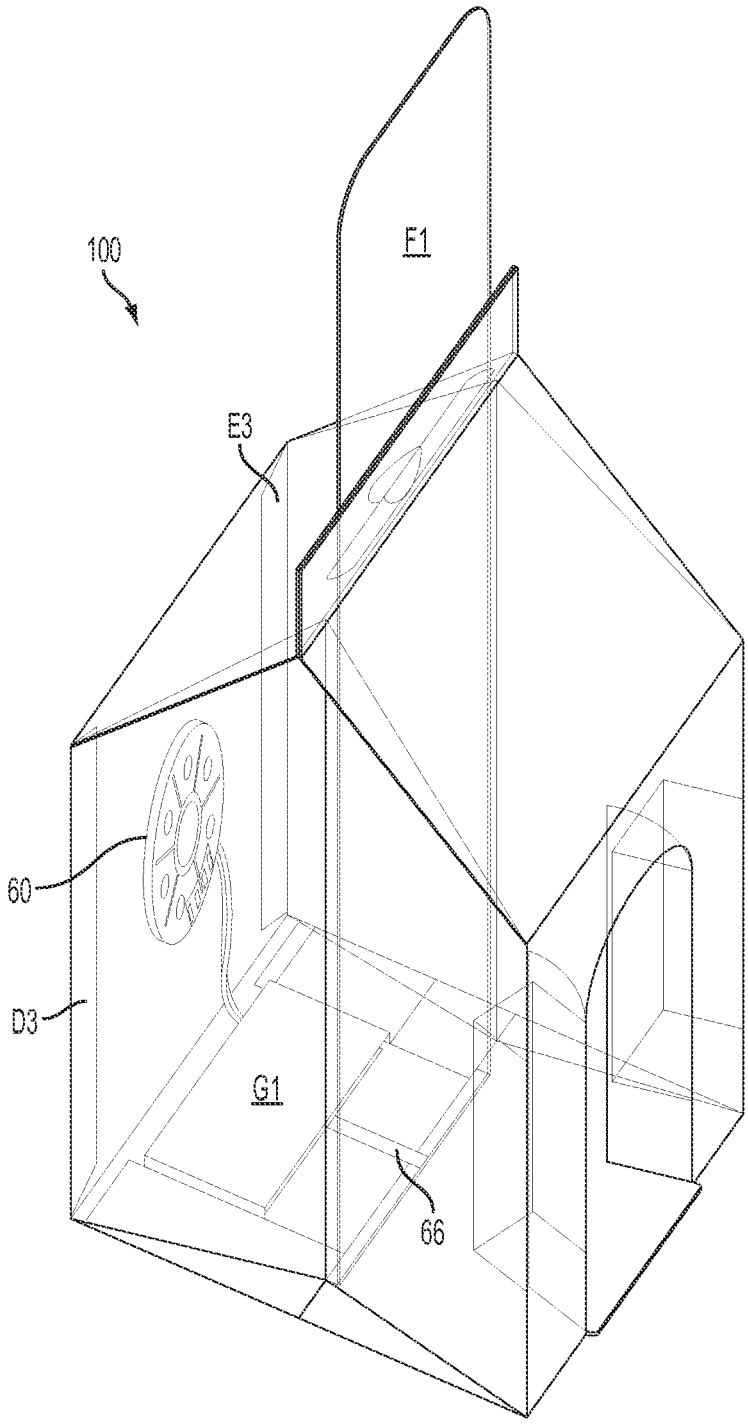
FIG. 5 is a perspective view of the inner panels of the greeting card.
Figure 6:
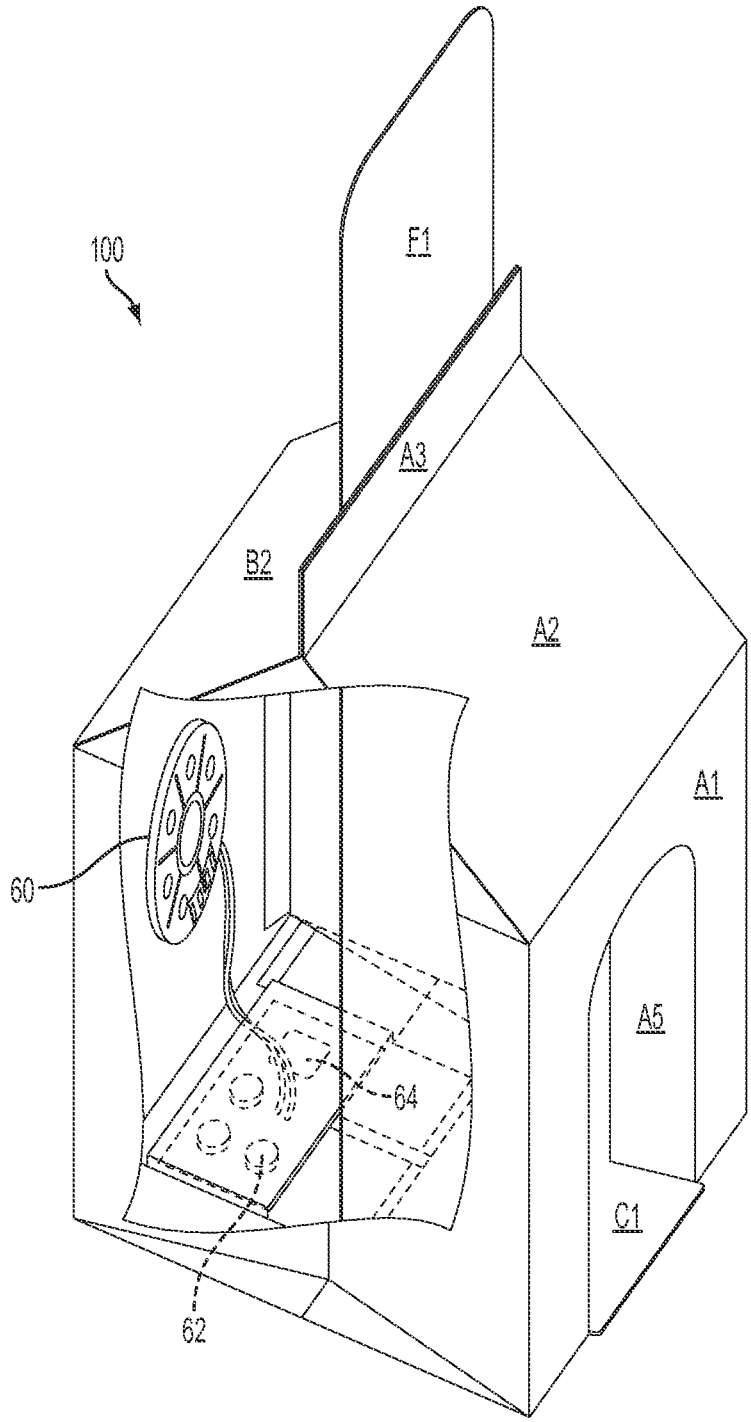
FIG. 6 is a cutaway view of the internal electronic components of the greeting card.

Various electronic components may be contained and concealed within the outer greeting card construct, as shown in FIGS. 5 and 6. As mentioned above, the electronic components may be attached to the floor or main panel C, with a speaker 62 mounted to the inside surface of panel B1. The electronic components may be operative to play sound, activate lights or perform other special effects or a combination thereof. Electronic components may include, but are not limited to: a printed circuit board with microprocessor 64, an integrated circuit chip, a controller, a power source 60, a speaker 62, a switch 66, a memory device, and one or more digital files stored on the memory device. Any number of other electrical components are contemplated such that the greeting card may be operative to play sound, activate lights, activate motorized moveable components, record messages, accept digital data files from an outside source such as a personal computer, or perform any other special effects. Such components and related circuitry are known to one of ordinary skill in the art. The special effects may be coordinated with the theme of the greeting card. For example, in a preferred embodiment, described herein and shown in the figures, the greeting card resembles a café whereby the shape of the greeting card construct and the related artwork and text printed thereon are used to represent a small cafe. When the greeting card 100 is moved from the first or folded position to the second or unfolded position, sound may be activated wherein such sound may be an instrumental music clip of something one might hear while in a café. One or more lights, such as LED lights, may also be contained within the outer greeting card construct and may be visible through various apertures contained on the various greeting card panels. Also, lights may be located inside the outer greeting card structure behind a semi-transparent screen such that the light creates a backlight behind the scene revealed on the sentiment panel. Such lights may be activated, along with or instead of activation of the digital audio, when the greeting card is moved from the first or folded position to the second or unfolded position. The lights may be clear white lights or they may be of various colors. Various types or formats of audio files may be contained on a memory device, including but not limited to: MP3, .mp4, AAC, .wav, etc. The various audio files may contain various content including, but not limited to: a spoken greeting, such as a celebrity voice; a music clip such as from a popular song; an instrumental music clip; an animal sound, etc. In one embodiment, the greeting card may be operative to upload digital audio files from an external source via a USB cable or SD card slot contained within the greeting card construct. In another embodiment, the greeting card may be operative to record a personal message from a user. These uploaded audio files or user-recorded messages may be played back upon a greeting card recipient moving the greeting card from the first or folded position into the section or unfolded position. They may also be played in combination, either before, after or simultaneously with a pre-recorded audio saved within memory on the greeting card.

Figure 3:
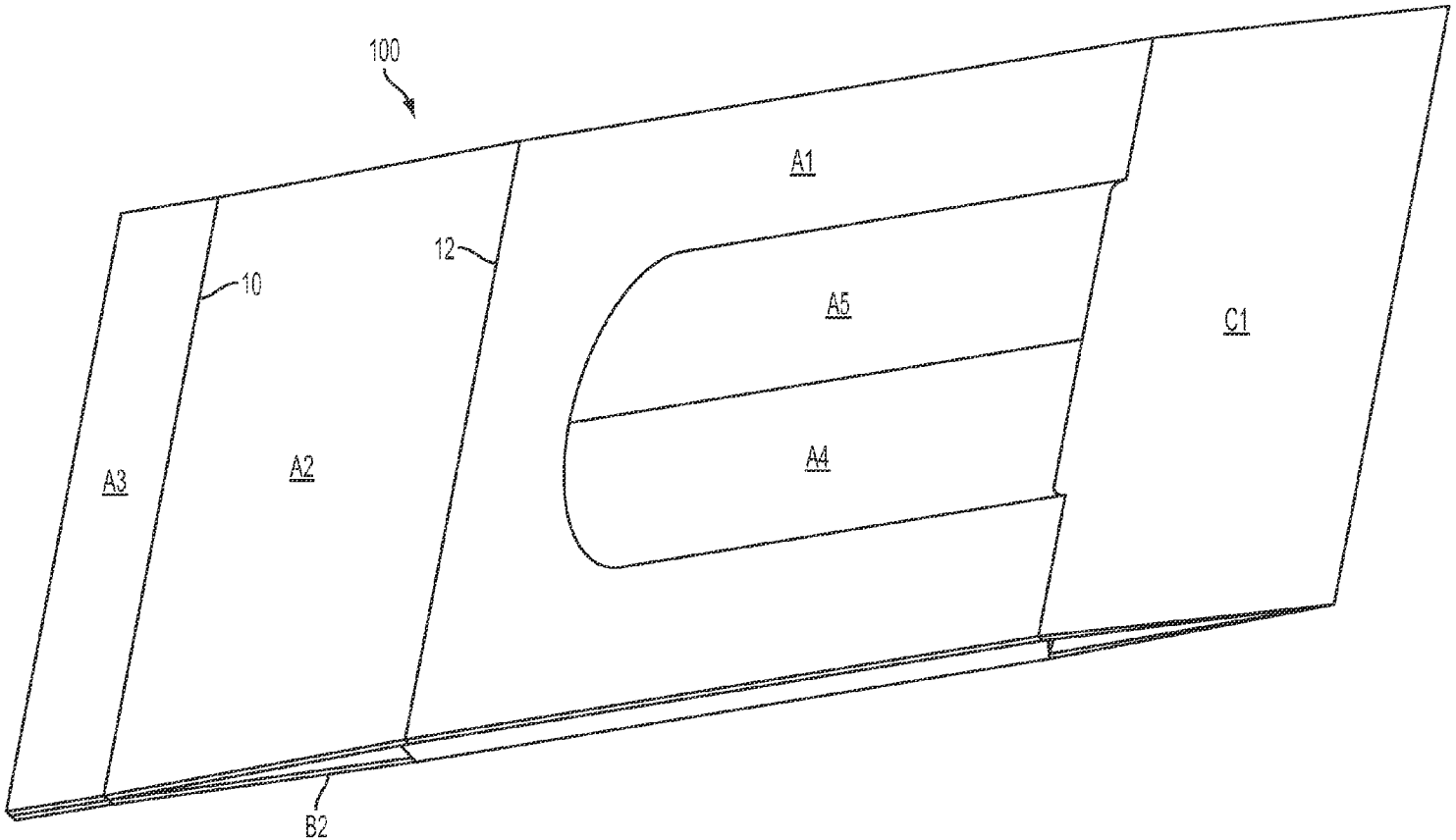
FIG. 3 is a perspective view of the greeting card in a first or folded position.
Figure 4:
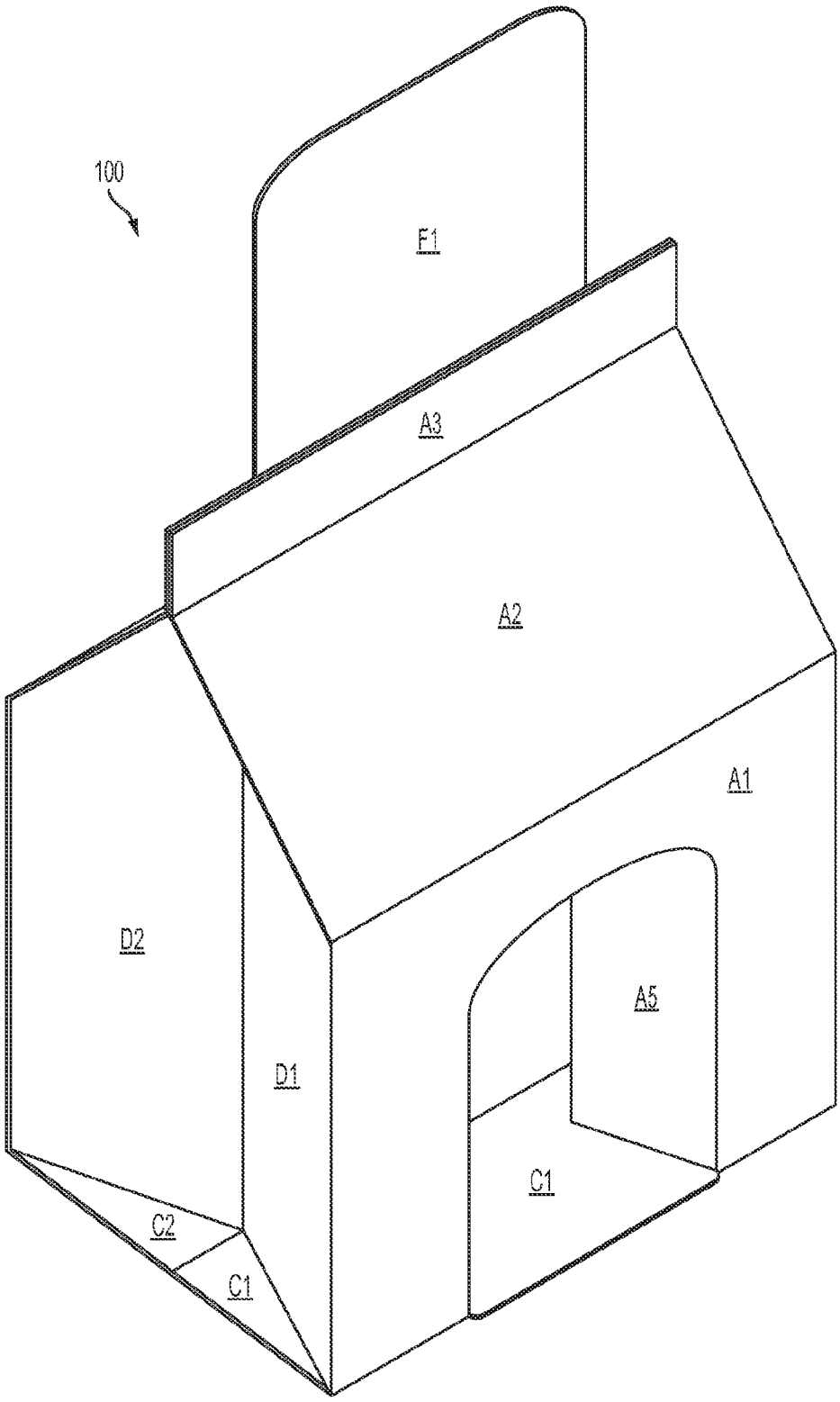
FIG. 4 is a perspective view of the greeting card in a second or unfolded position.
Figure 7:
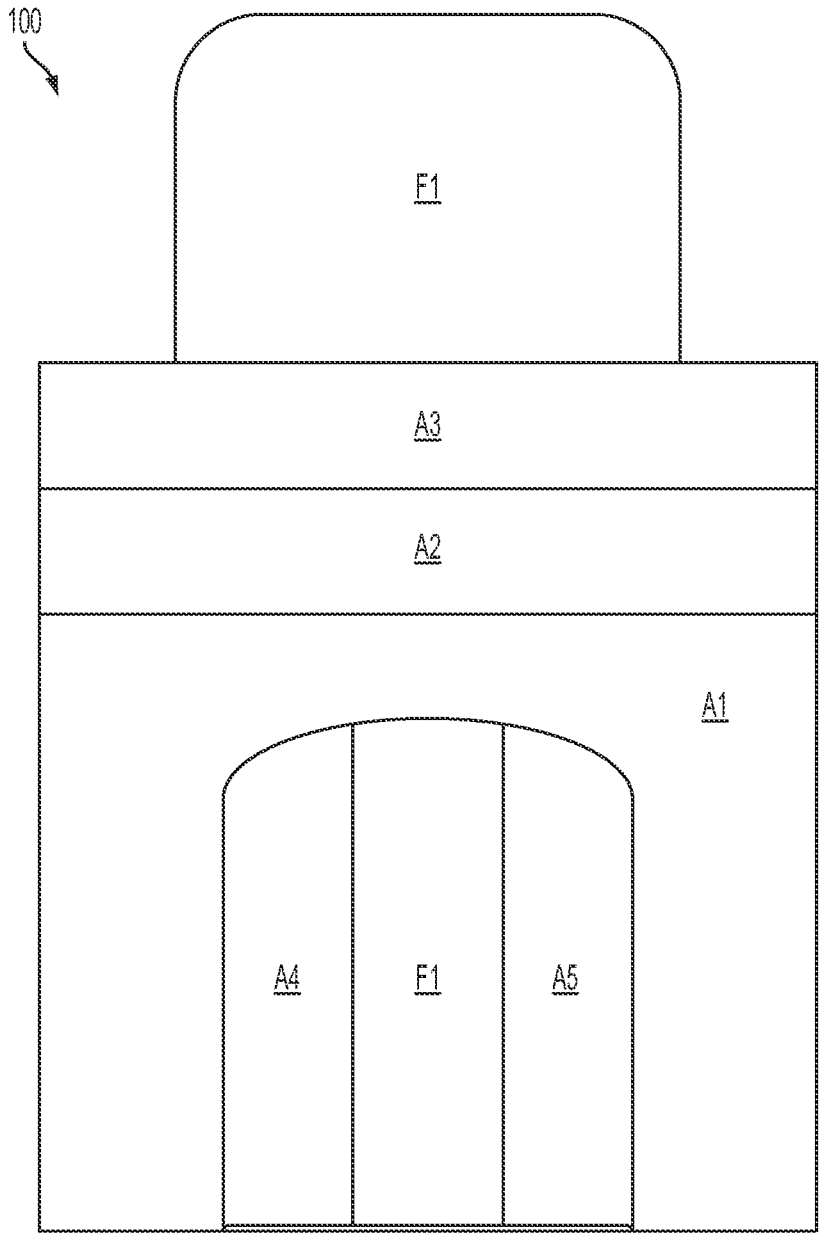
FIG. 7 is a front view of the greeting card in the second or unfolded position.
Figure 8:
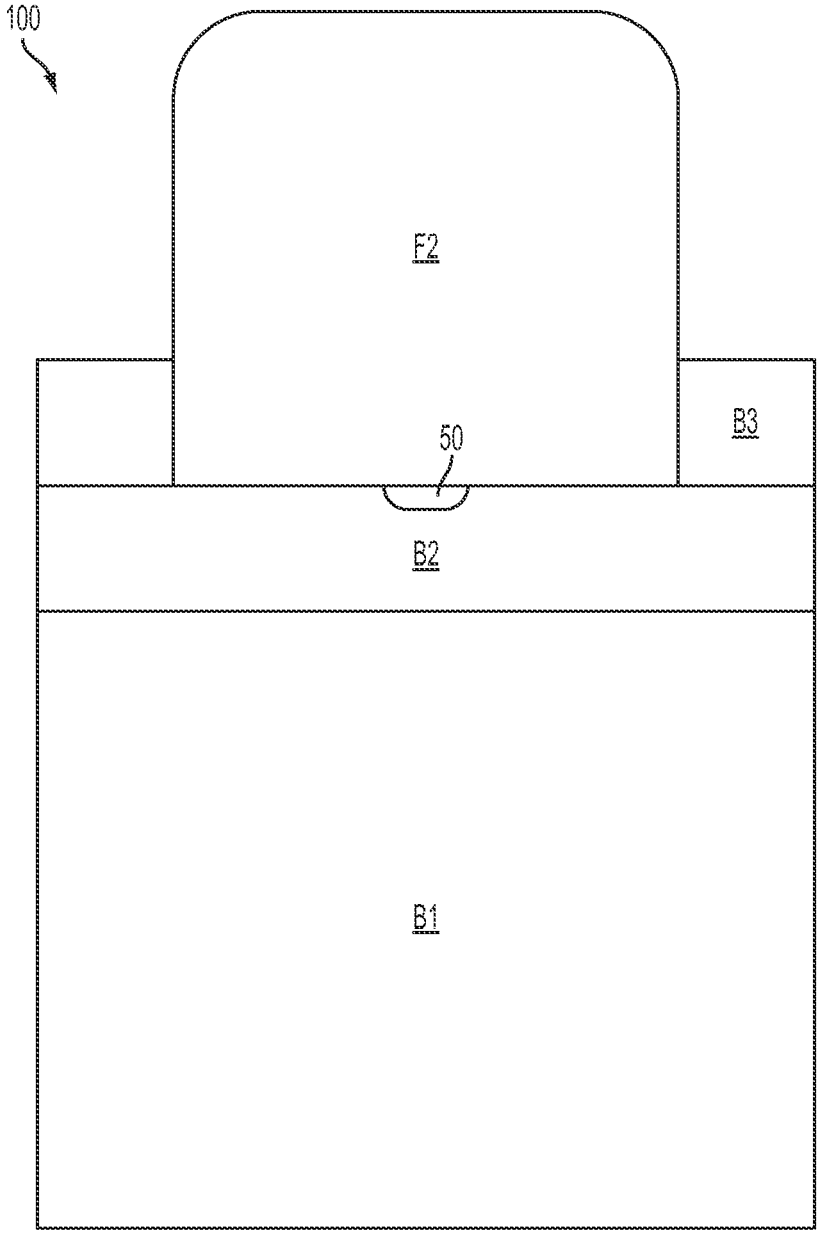
FIG. 8 is a back view of the greeting card of FIG. 7.

In operation, the greeting card 100 moves from a first position wherein the greeting card 100 is folded into a substantially flat position, shown in FIG. 3, to a second position wherein the greeting card 100 is unfolded into a three-dimensional structure, shown in FIGS. 4, 7, and 8. When the greeting card 100 is in the first or folded position, it can be inserted into a traditional, standard-sized envelope. To move the greeting card 100 into the second or unfolded position, a user must take hold of the greeting card, such as between a forefinger and thumb, in the upper region of the card, such as over sub-panels A3 and B3, and push the card in a downward direction. An instructional removable sticker may be placed on sub-panels A3 or B3 instructing the user to "push down to pop open". Pushing the card 100 in a downward direction, unfolds the various folded panels constructing the three-dimensional café-like structure. This also causes the sentiment panel F to be revealed from the front of the greeting card 100 through the slot 40 contained on the back of the greeting card (sub-panel B2) and also through the open doors or sub-panels A4 and A5. The sentiment panel F may contain an appropriate thematic scene through sub-panels A4 and AS such as a small café table and chairs. The upper portion of the sentiment panel F, which is visible over the top of the greeting card 100 as it comes into view through the slot in sub-panel B2, may contain text sentiment, such as "Happy Birthday" or additional artwork or a combination thereof. In addition to revealing the sentiment panel F, moving the greeting card 100 from the first or folded position to the second or unfolded position may also trigger playback of a digital audio file and/or activation of one or more LED lights contained within the greeting card 100. The special effects, such as the sound generation and light activation, may be controlled by a slide switch 66, located along with the other electronic components, on sub-panel C2. The tongue portion of the slide switch 66 may extend, for example, across fold line 32 between panels C1 and C2 such that when the greeting card 100 is opened or moved from the first or folded position to the second or unfolded position, the tongue portion of the slide switch 66 is moved thereby allowing power to the circuit. The special effects, such as the audio and/or lights, may be deactivated by placing the greeting card 100 back into the first or folded position. The greeting card 100 may be maintained in the second or unfolded position by inserting the bottom edge of the elongate slot 40 on sub-panel B2 under the tab 50 located on sub-panel F2. In this case, the special effects, such as the sound generation and/or light activation may turn off or deactivate after the greeting card 100 remains in the second or unfolded position for a certain period of time, such as 10 or 20 seconds or more, to preserve the life of the battery. While a slide switch has been described herein, any type of switch may be used, including, but not limited to: a magnetic switch; a light-sensitive switch; and a touch-sensitive switch.

It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive. Other features and aspects of this invention will be appreciated by those skilled in the art upon reading and comprehending this disclosure. Such features, aspects, and expected variations and modifications of the reported results and examples are clearly within the scope of the invention where the invention is limited solely by the scope of the following claims.

What is claimed is:

1. A greeting card comprising:

an outer greeting card structure having a front panel, a back panel parallel to the front panel, two side panels that extend perpendicularly between the front and back panel, and a bottom panel;

an inner panel, a portion of said inner panel being located within the outer greeting card structure and a portion of said inner panel being located outside of the outer greeting card structure;

a sound module located within the outer greeting card structure and operative to store and play at least one digital audio file;

the greeting card being moveable between a first position wherein the greeting card is folded substantially flat and a second position wherein the greeting card is unfolded into a three-dimensional structure;

wherein when the greeting card is moved from the first position to the second position, the sound module is triggered to play the at least one digital audio file, and wherein the front panel of the outer greeting card structure contains an opening thereon that is covered by two flaps when the greeting card is in the first position, said flaps folding inward to reveal a portion of the inner panel when the greeting card is in the second position.

2. The greeting card of claim 1 further comprising one or more LED lights contained within the outer greeting card structure or inner panel that are activated upon moving the greeting card from the first position to the second position.

3. The greeting card of claim 1, wherein the back panel of the outer greeting card structure contains a slot thereon through which a portion of the inner panel exits the outer greeting card structure.

4. The greeting card of claim 1, wherein the front panel of the outer greeting card structure contains an opening thereon which a portion of the inner panel can be seen when the greeting card is in the second position.

5. The greeting card of claim 1, wherein the inner panel contains a locking tab thereon which operates to lock the greeting card in the second position.

6. A greeting card comprising:

a greeting card body comprising a front panel, a back panel parallel to the front panel, a right and left side panel perpendicular to and extending between a portion of the front and back panels, and a bottom panel which is connected to the front and back panels;

an inner panel which is connected to the bottom panel, parallel to the front and back panels, a portion of the inner panel contained within the greeting card body and a portion of the inner panel contained outside of the greeting card body through a slot contained on the back panel;

a sound module contained an concealed within the greeting card body;

in a first position, the greeting card body is folded into a substantially flat structure, and in a second position the greeting card body is unfolded into a three-dimensional structure;

a locking tab contained on the inner panel that works in combination with the slot contained on the back panel to maintain the greeting card in the second position;

a switch which controls power to the sound module, wherein when the greeting card is in the first position, the switch prevents power to the sound module and when the greeting card is in the second position, the switch permits power to the sound module thereby initiating playback of at least one digital audio file contained within the sound module.

7. The greeting card of claim 6 further comprising an opening in the front panel wherein when the greeting card is in first position, the opening is covered by two flaps and when the greeting card is in the second position, the two flaps are folded into the greeting card body thereby revealing a portion of the inner panel.

8. The greeting card of claim 7 further comprising one or more LED lights contained on the inner panel, the one or more LED lights being activated when the greeting card is moved from the first position to the second position and seen through the opening on the front panel.

9. The greeting card of claim 6 further comprising one or more LED lights contained within the greeting card body, the one or more LED lights being activated when the greeting card is moved from the first position to the second position.

10. The greeting card of claim 6, wherein when the greeting card is maintained in the second position, the at least one digital audio file ceases to play after 20 seconds or less.

11. The greeting card of claim 6, wherein when the greeting card is in the second position, a larger portion of the inner panel is contained outside the greeting card body through the slot contained on the back panel.

12. The greeting card of claim 6, wherein the inner panel contains a greeting or message that is revealed when the greeting card is in the second position.

13. A greeting card comprising:

a greeting card body comprising a front panel attached along a top edge to a back panel which is parallel to the front panel, the front and back panels attached along a bottom edge to a floor panel, and right and left side panels perpendicular to and extending between the front and back panels;

an inner panel which is parallel to and located between the front and back panels, the inner panel being attached along a bottom edge to the floor panel, an upper portion of the inner panel located outside the greeting card body through a slot located on the back panel;

a sound module which is attached to the floor panel and concealed within the greeting card body, the sound module comprising a circuit board, an integrated circuit chip, a microprocessor, a speaker, a switch mechanism, a memory device, at least one digital audio file contained on the memory device, and a power source;

the front panel having an opening thereon which is covered by the two flap panels;

the inner panel having a locking tab contained thereon;

the greeting card operative to move from a first position wherein the greeting card body is folded flat along several fold lines to a second position wherein the greeting card is folded along the several fold lines to a three-dimensional pop-up structure;

wherein when the greeting card is moved from the first position to the second position, the switch triggers playback of the at least one digital audio file, the two flap panels covering the opening on the front panel are folded inward revealing a portion of the inner panel, and a larger portion of the inner panel is removed from the greeting card body through the slot located on the back panel.

14. The greeting card of claim 13, wherein moving the greeting card from the second position back to the first position, deactivates playback of the at least one digital audio file, the two flap panels unfold to cover the opening on the front panel, and a portion of the inner panel is inserted back into the greeting card body.

15. The greeting card of claim 13 further comprising one or more LED lights contained within the greeting card body and visible through one or more panels of the greeting card body or the inner panel.

16. The greeting card of claim 15, wherein the one or more LED lights are activated by the switch mechanism when the greeting card is moved from the first position to the second position.

17. The greeting card of claim 13, wherein the greeting card can be maintained in the second position by moving the locking tab into position that is perpendicular to the slot located on the back panel.

18. The greeting card of claim 17, wherein playback of the at least one digital audio file ceases when the greeting card is moved from the second position to the first position or when the at least one digital audio file has played to its entirety.

* * * * *